US005224282A

United States Patent [19]

Swick

[11] Patent Number: 5,224,282

[45] Date of Patent: Jul. 6, 1993

[54] TOOTH ASSEMBLY FOR A DIGGER BUCKET

[75] Inventor: Carl D. Swick, Mukwonago, Wis.

[73] Assignee: Harnischfeger Corporation, Brookfield, Wis.

[21] Appl. No.: 823,417

[22] Filed: Jan. 21, 1992

[51] Int. Cl.[5] ..... E02F 9/28

[52] U.S. Cl. ..... 37/453; 37/454

[58] Field of Search ..... 37/141 T, 141 R, 142 A, 37/142 R

[56] References Cited

U.S. PATENT DOCUMENTS

| | | | |
|---|---|---|---|
| 4,120,105 | 10/1978 | Stepe | 37/141 T X |
| 4,136,469 | 1/1979 | Zepf | 37/141 T |
| 4,238,896 | 12/1980 | Lanz et al. | 37/141 R |
| 4,329,794 | 5/1982 | Rogers | 37/117.5 X |
| 4,414,764 | 11/1983 | Johansson et al. | 37/141 T |
| 4,449,309 | 5/1984 | Hemphill | 37/141 T X |
| 4,510,706 | 4/1985 | Berchem | 37/141 T X |
| 4,704,812 | 11/1987 | Paramore, Jr. | 37/141 R |
| 4,782,607 | 11/1988 | Frisbee et al. | 37/141 T |
| 4,932,145 | 6/1990 | Reeves, Jr. | 37/141 T |

*Primary Examiner*—Dennis L. Taylor
*Assistant Examiner*—J. Russell McBee
*Attorney, Agent, or Firm*—Richard C. Ruppin

[57] ABSTRACT

The invention is an improvement in a tooth assembly used with excavating and digging buckets such as those found in draglines, backhoes and the like. Such tooth assemblies include a top portion (such as a wear cap), a nose protruding beyond the portion and a digging tip. The tip has high-hardness upper and lower exterior wear surfaces and a sharp-edged tip end for biting into earth, mineral and rock. Either embodiment of the improved assembly involves mounting parts (a tip or tip and sleeve) directly on the nose. In one improved assembly, a sleeve is interposed between the tip and the portion and includes high-hardness wear surfaces extending between tip and portion. The tooth and sleeve cooperate to substantially entirely shroud the nose. In another version having no sleeve, the tip includes high-hardness active digging surfaces extending substantially entirely rather than only partially between the portion and the tip end. The tooth entirely shrouds the nose rather than being attached to the nose by a separate tip holder. With the improved arrangements, the tip and sleeve (or tip alone) comprise the primary replaceable parts and the nose is protected in that it is between high-hardness surfaces.

12 Claims, 4 Drawing Sheets

FIG. 3
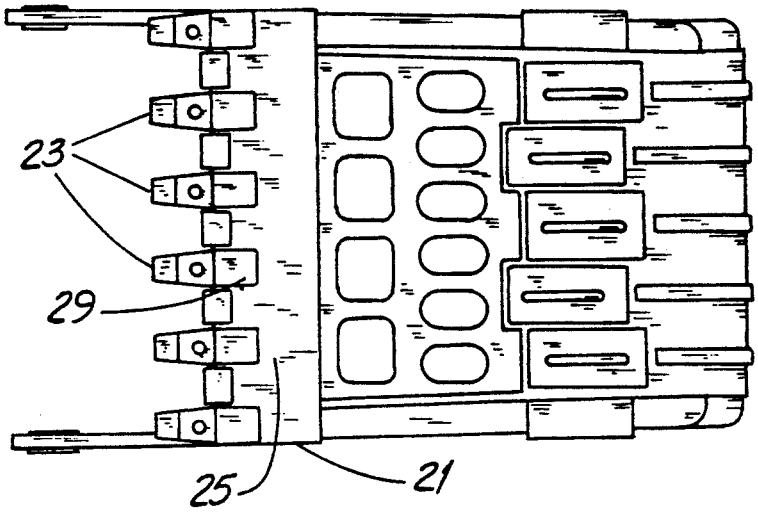
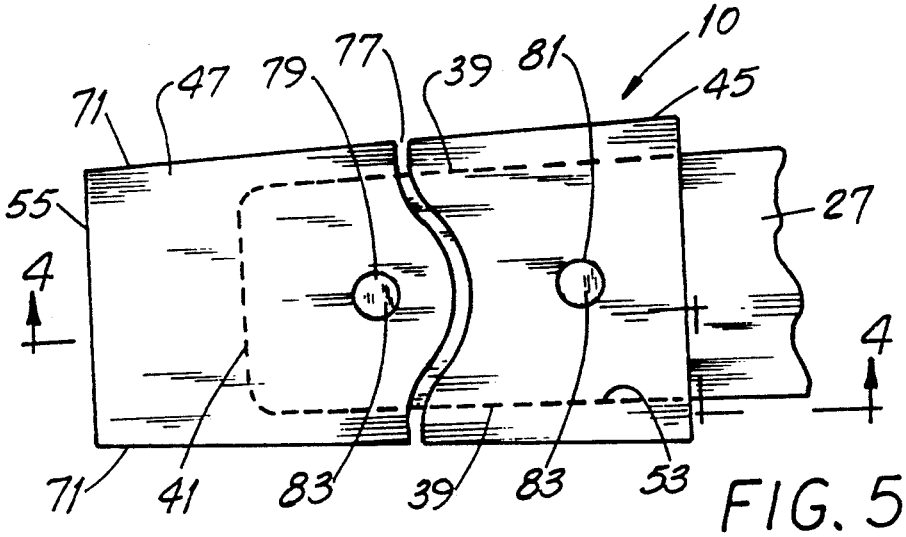
FIG. 5
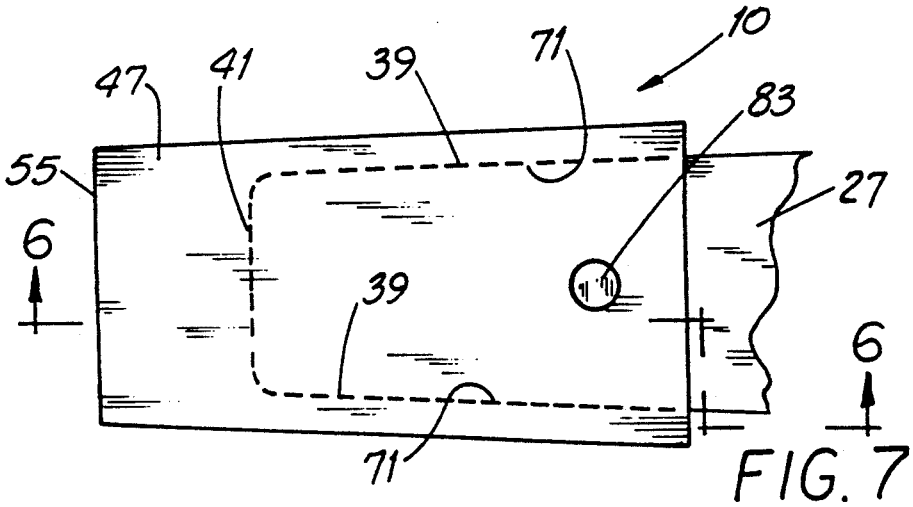
FIG. 7

PRIOR
ART

PRIOR
ART

TOOTH ASSEMBLY FOR A DIGGER BUCKET

FIELD OF THE INVENTION

This invention is related generally to digging, excavating and dragline mining equipment and, more particularly, to tooth assemblies used on the digging buckets of such equipment.

BACKGROUND OF THE INVENTION

Certain types of earth-moving and excavating machinery are equipped with digging buckets capable of holding anywhere from a fraction of a cubic yard to several cubic yards of material. One type of machine using a large digging bucket is called a walking dragline. Such draglines are often used in strip mining to remove "overburden" material covering, e.g., coal or ore, and to remove the product being mined. A large dragline may represent an investment of well over a million dollars; downtime is expensive, adds to the consumer cost of the product being mined and must be minimized.

Draglines are very large and include an enclosed machinery deck mounted on movable "legs" for machine transportability over a limited area. The machinery deck includes drive motors, cable reels, clutches and the like for manipulating a boom and boom-suspended bucket. The boom extends outward from the machinery deck by a distance of, for example, 300 feet or so. The digger bucket is attached to cables, one of which extends downward from the end of the boom to support the bucket weight. The other cable extends between the bucket and the machinery deck.

Digging is by lowering the bucket onto the material to be removed and dragging the bucket toward the machinery deck. As the bucket is drawn toward the machine, its digging teeth bite into the material as the bucket fills. After the bucket is filled, the boom is swung laterally and the bucket tipped for dumping the load. For a large dragline, the bucket capacity may be 80–90 cubic yards or even larger. And there are other types of machines, e.g., excavators, backhoes and the like, which use digger buckets mounted on articulated arms.

Because such digger buckets are subjected to severe use, often in hard mineral such as limestone, coal or rock, the bucket digging teeth wear or break and are arranged for replacement. A large bucket may have several tooth assemblies, the individual components of which are typically quite large.

In a conventionally-configured tooth assembly, the bucket includes a number of base noses protruding from the front, digging edge of the bucket. While such noses are intended to be a non-expendable, permanent part of the bucket, they sometimes break and replacement is required. Each such nose is fitted with a tooth holder and in a tooth assembly for a large bucket, such holder may be about 20 inches long (measured in the direction of digging) and weigh in excess of 450 pounds. A digging tip is attached to the holder and may have a length of 13 inches or so (as measured in the direction of digging), a width of about 12 inches and weigh about 160 pounds. Clearly, repair of such tooth assemblies is no trivial task. And during repair, the dragline is out of service for some period of time.

Conventional tooth assemblies are attended by certain disadvantages. One is that base noses, being of relatively small cross-sectional area, can break with annoying frequency. Since the base nose is a major component of the bucket per se, the resulting downtime can be enormously expensive.

Another problem with known tooth assemblies is that the tooth holder (interposed between the tip and the nose) also includes a nose piece which is subject to undue breakage. One reason is that a conventional tooth holder has an exposed surface which is sufficiently hard to reasonably withstand abrasive wear during digging. However, the holder must also be sufficiently ductile to withstand the rigors of digging without undue "brittle fracture." It is very difficult to make a holder with such inconsistent hard/ductile characteristics and, in fact, the exposed surfaces of the holder are of moderate hardness—unlike the high-hardness exposed surfaces of the tip. As a consequence, the exposed holder tends to wear at a disadvantageous rate. And for a particular size of tooth assembly, the holder itself is made of a large mass of metal and represents an item of significant cost. Still another problem is that the digging tip, intended to be replaced when worn, also includes a large mass of metal, a fact reflected in the costs of such tips.

An improved tooth assembly which is more resistant to breakage, which has a "beefier" base nose cross-sectional area for impact resistance, which is easier to manufacture and which has a tip of relatively small mass for easy replacement would be an important advance in the art.

OBJECTS OF THE INVENTION

It is an object of this invention to provide an improved tooth assembly overcoming some of the problems and shortcomings of devices of the prior art.

Another object of this invention is to provide an improved tooth assembly configured to reduce breakage of the base nose.

Still another object of this invention is to provide an improved tooth assembly having, in one embodiment, a reduced number of parts.

Another object of this invention is to provide an improved tooth assembly wherein for a replaceable tooth sized for a particular bucket, the comparative weight of such tooth is reduced.

Another object of this invention is to provide an improved tooth assembly having, in another embodiment, an expendable sleeve of low mass and high surface hardness and which lends itself to manufacture in a variety of ways.

These and other important objects will be apparent from the following descriptions taken in conjunction with the drawing.

SUMMARY OF THE INVENTION

The invention is an improvement in an excavating bucket tooth assembly of the type which includes a wear cap or similar top portion, a nose protruding beyond the portion and a sharp-edged digging tip with high-hardness upper and lower exterior wear surfaces. The invention involves mounting a sleeve and tip (or a tip alone) directly on the nose. In one highly preferred arrangement, the improvement comprises a sleeve interposed between the tip and the top portion and including high-hardness wear surfaces extending between the tip and such portion. The tooth and sleeve cooperate to substantially entirely shroud the nose and the durability of the nose surface is improved.

The improved tooth assembly presents opportunities for selection of surface hardness consistent with function, e.g., wear resistance or shock absorption. For example, in one version, the nose has at least one and preferably two exterior surfaces (one each top and bottom) of a hardness less than the hardness of the wear surfaces and preferably of moderate or lower hardness. The tip and the sleeve are of graduated hardness and each has at least one interior surface and preferably two such surfaces, one each upper and lower, in contact with the nose surfaces. Such interior surfaces have a hardness less than the hardness of the wear surfaces and these, too, are preferably of moderate or lower hardness. Or the sleeve and/or the tip can be of high-hardness material throughout.

For improved absorption of digging force, surface-to-surface contact area is maximized. That is, substantially the entirety of the upper and lower interior surfaces of the tip and the sleeve are in surface contact with a nose surface thereby providing high surface contact area. While the nose, tip and sleeve can be configured with curved or irregular surfaces and still obtain maximum surface-to-surface contact, such configuration requires close-tolerance control in casting and subsequent shaping. In the improved assembly, the nose has generally flat top and bottom surfaces. The tip and the sleeve (or the tip alone) each have generally flat upper and lower interior surfaces and the nose is tapered to receive the tip and the sleeve with tapered, wedge-like fit. In that way, the area of tip and sleeve contact with the nose is maximized while yet avoiding the need for such close-tolerance shaping.

Mechanical designers recognize that when holes or apertures are formed in or through the nose for pinned tip and/or sleeve retention, regions of increased stress in the nose (often called "stress risers") can result. In the invention, the tip and sleeve (or tip alone, as the case may be) are each retained on the nose by a single retaining pin thereby providing increased resistance against nose breakage.

But that is not all. It is also recognized that the upper surfaces of the tip and sleeve are those which wear more rapidly as compared to the rate of wear of the lower surfaces. To avoid the necessity of discarding an expensive tip or sleeve when only its upper surface is worn, each such piece is configured to be invertible on the nose between either of two positions whereby the life of the tip and sleeve are extended. In a similar arrangement, the sleeve has four wearing surfaces and engages the nose in a tapered, wedge-like fit in any of four positions.

Another preferred embodiment of the improved tooth assembly is devoid of a sleeve and incorporates a tip having high-hardness active digging surfaces extending between the portion and the tip end. The tooth substantially entirely shrouds the nose, is the primary replaceable part and the nose is protected between the high-hardness surfaces of the tip. And, of course, the area of nose-tip contact is maximized when the top and bottom surfaces of the nose are generally flat, the upper and lower interior surfaces of the tip are generally flat and the nose is tapered to receive the tip with wedge fit.

Further details of the improved tooth assembly are set forth in the detailed description and the drawing.

BRIEF DESCRIPTION OF THE DRAWING

FIG. 3 is a top plan view of the bucket of FIG. 2 taken in the viewing plane 3—3 thereof.

FIG. 5 is a top plan view of the tooth assembly of FIG. 4 with parts shown in phantom and other parts broken away.

FIG. 7 is a top plan view of the tooth assembly of FIG. 6 with parts shown in phantom and other parts broken away.

DETAILED DESCRIPTIONS OF THE PREFERRED EMBODIMENTS

Figure 1:
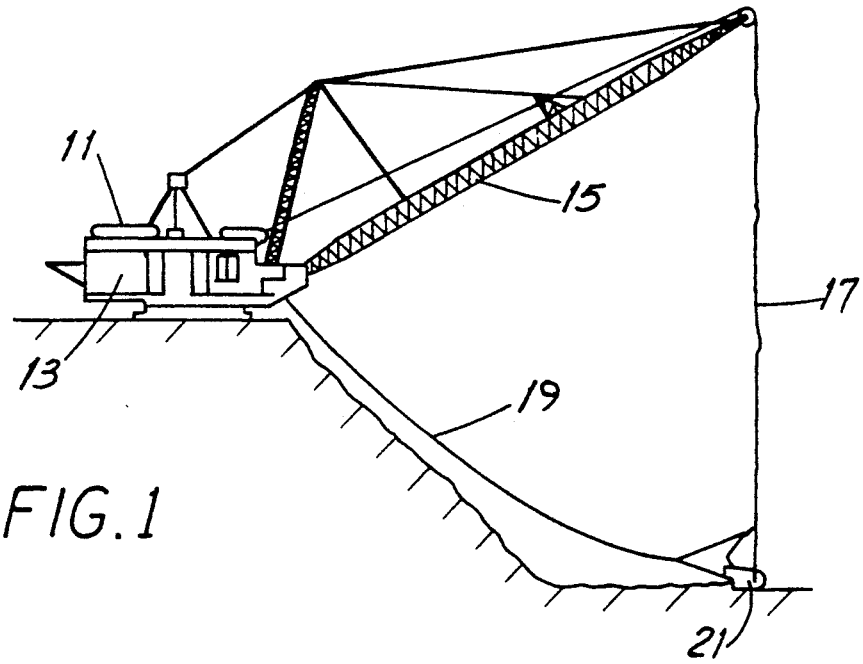
FIG. 1 is a side elevation view of a walking dragline in operation.
Figure 2:
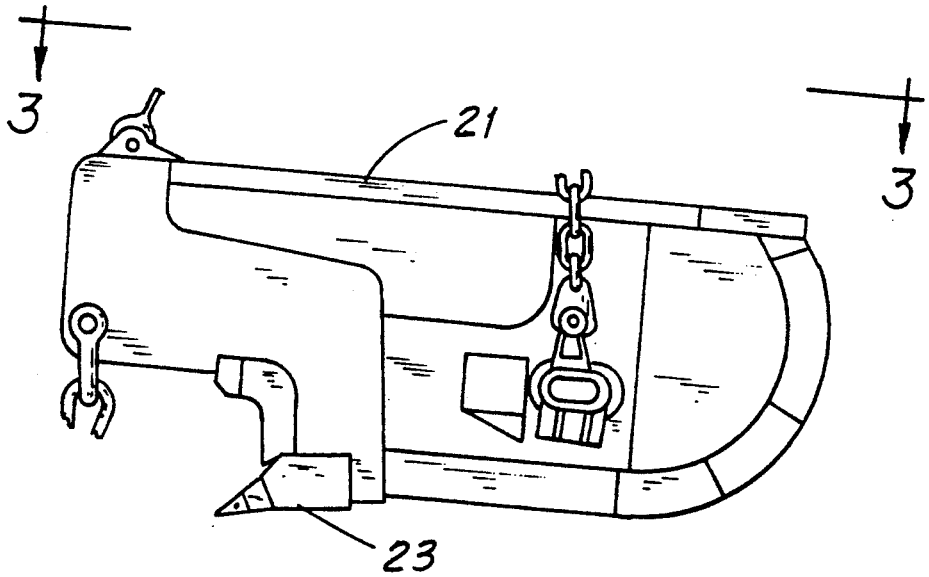
FIG. 2 is a side elevation view of a bucket used on the dragline of FIG. 1.

Before describing the inventive tooth assembly 10, it will be helpful to describe how such tooth assemblies are used and how a conventional tooth assembly 101 is configured. Following these descriptions, details of the new tooth assembly are provided.

Referring to FIGS. 1, 2, 3, 8A and 8B the illustrated walking dragline 11 includes a machinery deck 13, an extended boom 15 and cables 17, 19 hooked to the digging bucket 21. The cable 17 raises and lowers the bucket 21 and the cable 19 draws the bucket 21 toward the dragline 11 to load material into the bucket 21. The bucket teeth 23 bite into such material which fills the bucket 21 as it moves. Of course, such teeth 23 point toward the dragline 11 during digging.

In an exemplary configuration, the bucket 21 has a top portion 22 (which may be a separately-attached wear cap), a front lip 25 to which several tooth assemblies 10 or 101 are attached, usually by welding. Each tooth assembly 10 or 101 has a base 27 with an upper and lower jaw 29, 31, respectively, and a slot therebetween for receiving the lip 25. In the alternative, the base 27 may be cast with the lip 25 as an integral structure.

Figure 8B:
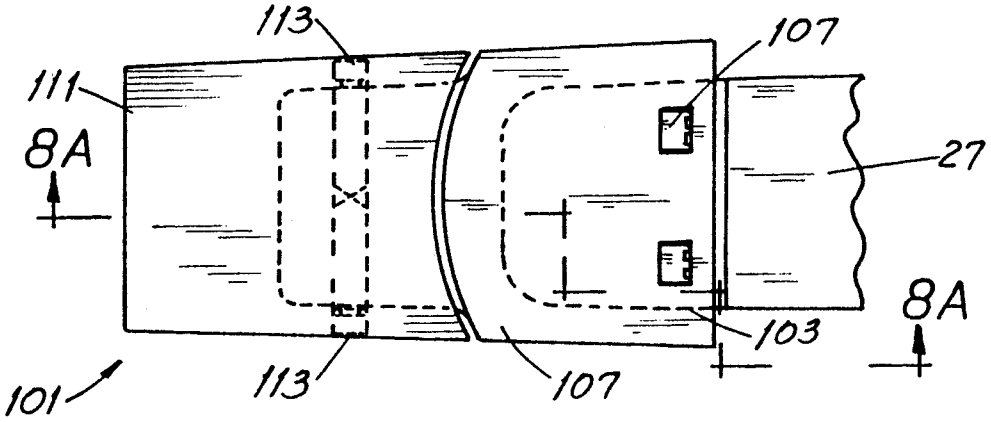
FIG. 8B is a top plan view, partly in phantom, of the tooth assembly shown in FIG. 8A and with parts broken away.
Figure 8A:
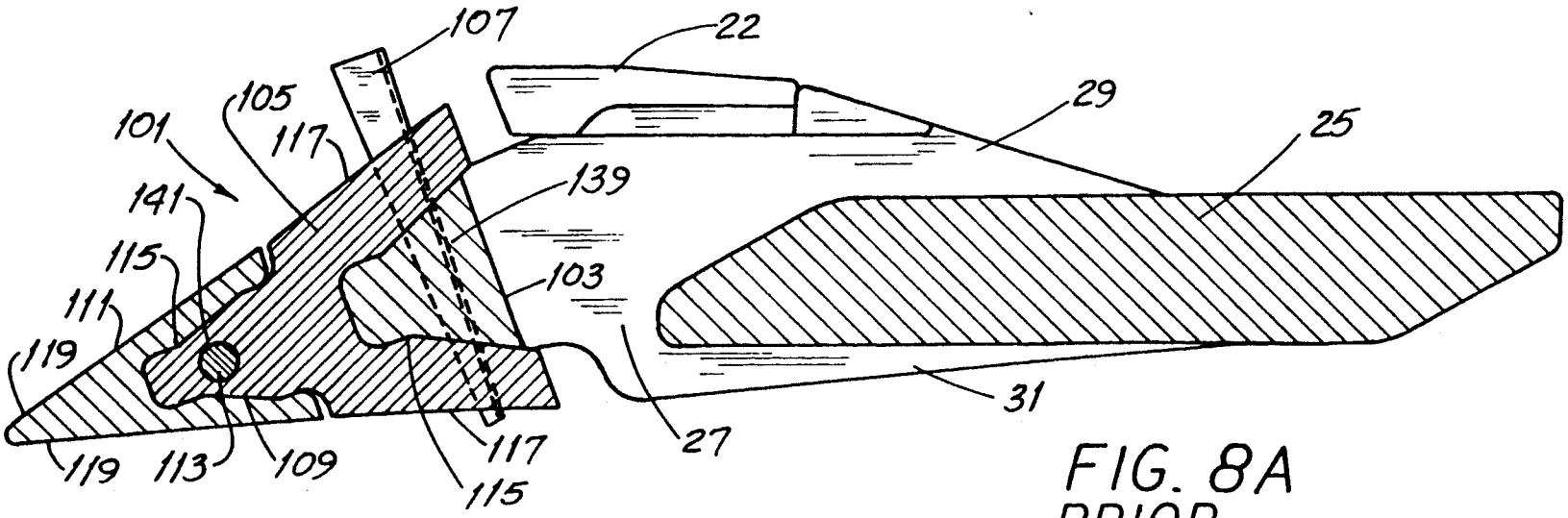
FIG. 8A is a side elevation view, partly in cross-section, of a conventional prior art tooth assembly.

FIGS. 8A and 8B show a conventional tooth assembly 101 in which the jaws 29, 31, the base 27 and the base nose 103 are made as a single piece. From this illustration, it is apparent that if the base nose 103 breaks, not an uncommon event, the entire piece must be removed and replaced. The base nose 103 (which needs to be somewhat "ductile" or resilient for good shock absorption) has a hardness in the range of about 270–300 as measured by the commonly-used Brinell hardness measuring system.

A tip holder 105 fits over the base nose 103 and is retained thereon by a keeper wedge (not shown) and a wedge pin 107. In an exemplary large tooth assembly, two such wedges and pins are used. The holder 105 has a necked-down distal end 109 receiving the replaceable tip 111 which slides over it. The end 109 and the tip 11 each have a pair of coaxial end-to-end holes receiving tip retention pins 113 driven in from opposite directions. Both the nose 103 and the end 109 (and parts mating with them) have surfaces 115 required to be shaped to close tolerances to provide an intimate metal-to-metal fit. In fact, the holder 105 is difficult to make by casting because of its complexity, shape and required tolerances. The upper and lower edges of the holder 105 opposite the end 109 may extend toward the portion 22 and base 27 to leave only slight clearance therebetween.

Because of its function, the holder 105 is subject to inconsistent hardness requirements. On one hand, it has exposed wear surfaces 117 which, ideally, should be of high hardness. On the other hand (and like the nose 103), it must be relatively ductile to absorb the shock of digging. The Brinell hardness of an exemplary holder 105 is in the range of about 320–375 which represents a compromise.

The tip 111 fits over the distal end 109 and even more than the holder 105, the tip 111 is subjected to extremely abrasive conditions which wear the surfaces 119. Preferably, such tip 111 has a hardness of at least about 475 Brinell.

As used herein, the term "high-hardness" means a hardness above about 375, the term "moderate-hardness" means a hardness in the range of about 320–375 and the term "lower-hardness" means a hardness below about 320. All such hardnesses are with respect to the Brinell system.

Figure 4:
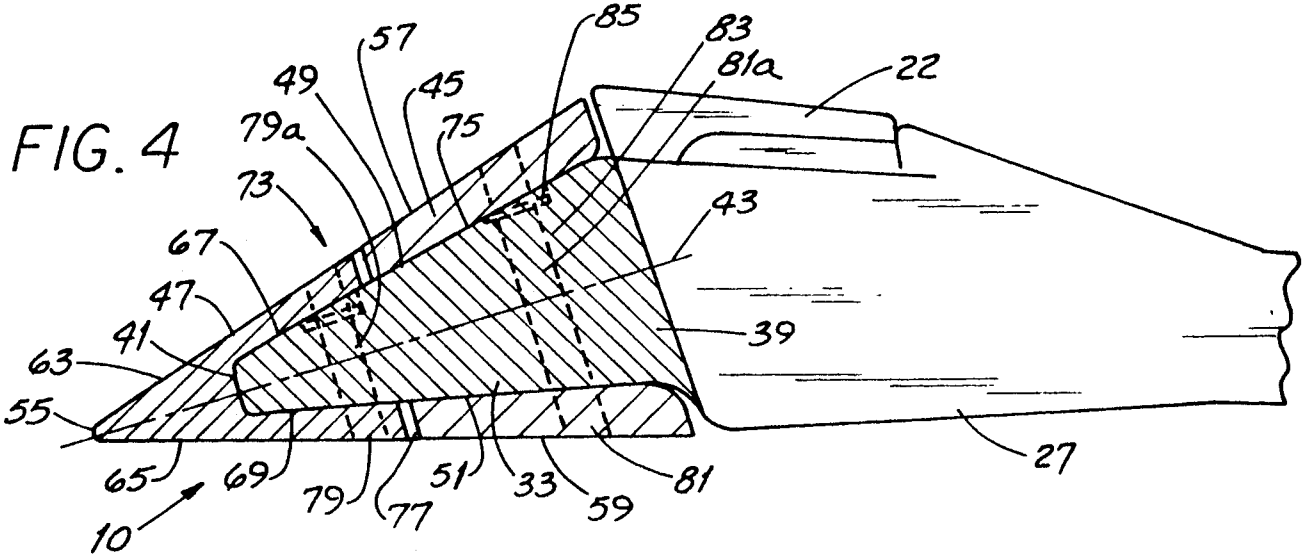
FIG. 4 is a side elevation view, partly in cross-section along the section lines 4—4 of FIG. 5, of one preferred embodiment of the improved tooth assembly used on the bucket of FIGS. 2 and 3.
Figure 6:
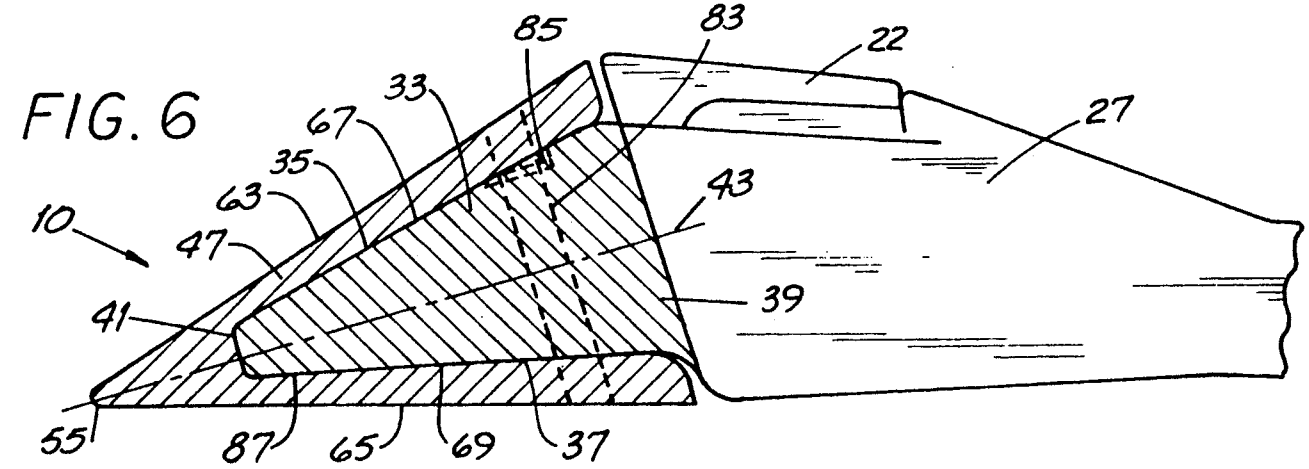
FIG. 6 is a side elevation view, partly in cross-section along the section lines 6—6 of FIG. 7, of another preferred embodiment of the improved tooth assembly used on the bucket of FIGS. 2 and 3.

Referring now to FIGS. 4 and 6, the inventive assembly 10 will now be described. The base 27 includes a nose 33 angled slightly downward with respect to the main portion of the base 27. The nose 33 has a top surface 35, a bottom surface 37, a pair of side surfaces 39 and a blunted nose end 41. Preferably, the side surfaces 39 are generally flat and parallel to one another while the top and bottom surfaces 35, 37 are angled toward the nose axis 43. The surfaces 35, 37 are also generally flat for reasons that will become apparent. The top and bottom surfaces 35, 37 of the nose 33 are of lower or moderate hardness and may be of uniform hardness throughout or of graduated hardness.

In an exemplary tooth assembly 10, each nose side surface 39 has a cross-sectional area which is at least about 30% greater than that of the comparable side surface 139 of the conventional nose 103 illustrated in FIG. 8A. And for some improved assemblies 10, such area may be as much as 40–50% greater. Clearly, this increased cross-sectional area adds very significantly to the strength and breakage resistance of the nose 33 without undesirably increasing the overall cross-sectional area of the assembly 10.

Referring next to FIGS. 4 and 5, a first preferred embodiment of the improved tooth assembly 10 includes a replaceable sleeve 45 and a replaceable tip 47. The sleeve 45 is hollow and has generally flat interior upper and lower and side surfaces 49, 51 and 53, respectively. Such surfaces 49, 51, 53 are located and arranged so that when the sleeve 45 is slipped over the nose 33 and urged tightly thereagainst in a tapered, wedge-like fit, the top and bottom surfaces 35, 37 of the nose 33 are in full contact with the counterpart surfaces 49, 51, respectively, of the sleeve 45. The sleeve 45 is often configured to provide very slight clearance between its side surfaces 53 and the counterpart surfaces 39 of the nose 33.

The sleeve 45 may be said to resemble a rectangular, truncated cone. It is to be appreciated that when the sleeve 45 is constructed to be generally symmetrical with respect to a plane coincident with the axis 43 and with the tip edge 55, the sleeve 45 may be removed, inverted 180° and reinstalled on the nose 33. This feature extends the life of the sleeve 45 since in a dragline bucket 21, its upper exterior surface 57 wears more quickly than its lower exterior surface 59. It is also to be appreciated that if the nose 33 has a square cross-section as viewed in a plane normal to the axis 43 and if the sleeve 45 is conformably shaped, the sleeve 45 can be oriented to place any one of four possible wearing surfaces, i.e., wearing surfaces 57, 59 or exterior side surfaces 61, at the top of the assembly 10.

The assembly 10 also includes a tip 47 mounted to abut the end 41 of the nose 33. The tip 47 has a relatively sharp edge 55, upper and lower exterior surfaces 63, 65 and upper and lower interior surfaces 67. 69, the latter in respective engagement with the top and bottom nose surfaces 35, 37. The interior side surfaces 71 of the tip 47 are parallel to the side surfaces 39 of the nose 33 and spaced to be in light contact with such surfaces 39 (or very slightly spaced from such surfaces 39) when the tip 47 is fully seated on the nose 33. The exterior upper and lower surfaces 63, 65 and 57, 59 of the tip 47 and the sleeve 45, respectively, are preferably coextensive with one another and generally define a triangle 73 which, in a highly preferred embodiment, is isosceles. And the interior upper and lower surfaces 67, 69 and 49, 51 of the tip 47 and sleeve 45, respectively, are likewise preferably coextensive with one another and define a triangle 75.

There is a slight gap 77 between the sleeve 45 and the tip 47 when both are fitted to the nose 33. In this way a certain amount of precision machining can be avoided. In other words, the sleeve 45 can be fully seated on the nose 33 without regard to whether the end 41 precisely abuts the tip 47 when the sleeve 45 is so seated. To put it yet another way, the gap 77 provides a certain amount of dimensional "forgiveness."

The sleeve 45 and the tip 47 each include a hole 81, 79, respectively sized and located to be in registry 81*a*, 79*a* with a corresponding hole formed in the nose 33. When the sleeve 45 and tip 47 are fully seated, conventional retaining pins 83 are driven home and snap rings 85 hold such pins 83 in place. It is to be appreciated that even when two retaining pins 83 are used as shown in FIGS. 4 and 5, the distance between the edge of a hole 79 or 81 and the side surface 39 of the nose 33 is relatively large for maximum nose strength. As in FIGS. 8A and 8B, compare, for example, the thickness of the metal remaining in the holder end 109 after the holes for the pins 113 are formed. Such thin wall section 141 in the conventional tooth assembly 101 contributes to premature holder breakage.

The first embodiment of the inventive tooth assembly 10 has advantages. One is that like the tip 111 and holder 105 of the conventional assembly, the tip 47 and sleeve 45 can be individually replaced. However, for a given tooth assembly 10 of the invention, the mass of the sleeve 45 is much lower than that of the holder 105 and less material is wasted upon discard. And individual "replaceability" is advantageous since a typical "wear-out rate" is about one sleeve 45 or holder 105 for every six tips 47 or 111 expended during digging. Another advantage is described above with respect to the improved section thickness contributing to nose strength.

Referring additionally to FIGS. 6 and 7, in a second preferred embodiment of the inventive assembly 10, the tip 47 is a single piece and includes uninterrupted, high hardness active digging surfaces 63, 65 extending between the portion 22 and the tip edge 55. And the tip 47 alone entirely shrouds and protects the nose 33. In this embodiment, the tip 47 is the primary replaceable part and the nose 33 is protected between high hardness surfaces 63, 65.

Like the tip 47 of the first embodiment, the tip 47 of the second embodiment has an interior cavity 87 sized and shaped to receive the nose 33. Such cavity 87 is bounded by upper and lower interior surfaces 67, 69 which, like the corresponding surfaces 35, 37 of the nose 33, are generally flat. The interior side surfaces 71 of the tip 47 are likewise generally flat. Tip fitting to the nose 33 is generally as described above with respect to the first embodiment.

The interior upper and lower tip surfaces 67, 69 are in substantially entire surface contact with the nose top and bottom surfaces 35, 37, respectively, and the tip 47 is retained on the nose by a single retaining pin 83. The use of only a single pin 83 provides increased resistance against nose breakage.

The improved tooth assembly 10 presents attractive opportunities for component hardness selection. For example, in the first embodiment, the sleeve exterior surfaces 57, 59 can be of high hardness rather than of moderate hardness as with the surfaces 117 of the holder 105 on conventional tooth assemblies 101. This is so since the sleeve 45 is mounted on a softer, ductile nose 33 for impact absorption. This helps cushion the sleeve 45. And the sleeve 45 resists compression and abrasion forces while the holder 105 is also required to resist bending forces; therefore, the need for ductility.

Such sleeve 45 can be through-hardened or only have high hardness exterior cladding with the interior of moderate hardness. If so clad, the exterior surfaces 57, 59 could have a hardness up to about 700 Brinell. Because of its straightforward configuration, the sleeve 45 can be made by casting or fabrication. And if the interior surfaces 49, 51 of the sleeve 45 are of moderate hardness like the top and bottom surfaces 35, 37 of the nose 33 this "hardness compatibility" helps extend the life of both the nose 33 and the sleeve 45.

Preceding text described how the nose 33 and sleeve 45 can be configured to permit inverted sleeve mounting or mounting of such sleeve 45 in any of four positions. After understanding that description, it is to be appreciated that as with the nose 33 and sleeve 45 of the first embodiment, the nose 33 and tips 47 of the first and second embodiments can be configured to permit inverting the tips 47 or mounting them in any one of four positions. This feature maximizes the amount of tip and sleeve material which can be "consumed" before the part needs to be replaced.

While the principles of this invention have been described in connection with specific embodiments, it should be understood clearly that these descriptions are made only by way of example and are not intended to limit the scope of the invention.

I claim:

1. In an excavating bucket tooth assembly including a top portion, a nose protruding beyond the portion and a digging tip with high-hardness upper and lower exterior wear surfaces and a sharp-edged tip end, the improvement comprising:

a tube-like sleeve between the top portion and the digging tip, the sleeve substantially surrounding the nose and having a pair of openings receiving the nose therethrough, the tip and sleeve extend along the nose and cooperate to substantially entirely shroud the nose, the tip and the sleeve are separate pieces and separately replaceable, the nose extends through the sleeve and into the tip.

2. The assembly of claim 1 wherein:

the nose has at least one exterior surface of a hardness less than the hardness of the wear surfaces;

the tip and the sleeve each have at least one interior surface in contact with such nose surface and having a hardness less than the hardness of the wear surfaces.

3. The assembly of claim 2 wherein the nose has top and bottom exterior surfaces of moderate hardness and the tip and the sleeve each have upper and lower interior surfaces of moderate hardness in contact with the exterior surfaces of the nose.

4. The assembly of claim 3 wherein substantially the entirety of the upper and lower interior surfaces of the tip and the sleeve are in surface contact with a nose surface thereby providing high surface contact area for improved absorption of digging forces.

5. The assembly of claim 1 wherein the tip is retained on the nose by a single retaining pin thereby providing increased resistance against nose breakage.

6. The assembly of claim 1 wherein the tip is retained on the nose by a single retaining pin thereby providing increased resistance against nose breakage.

7. The assembly of claim 1 wherein the sleeve is of high-hardness material throughout.

8. The assembly of claim 1 wherein the sleeve is of graduated hardness and includes moderate-hardness surfaces in contact with the nose.

9. The assembly of claim 1 wherein the sleeve is of graduated hardness and includes lower-hardness surfaces in contact with the nose.

10. The assembly of claim 1 wherein:

the nose has generally flat top and bottom surfaces;

the tip and the sleeve each have generally flat upper and lower interior surfaces; and, the nose is tapered to receive the tip and the sleeve with wedge-like fit, thereby maximizing the area of tip and sleeve contact with the nose.

11. The assembly of claim 1 wherein the nose has a central axis and the sleeve is generally symmetrical with respect to a plane coincident with the axis and the tip end, and the sleeve is therefore invertible on the nose between either of two positions whereby the life of the sleeve is extended.

12. The assembly of claim 11 wherein the sleeve has four wearing surfaces and wedge-fits the nose in any of four positions.

* * * * *